US009789693B2

(12) United States Patent
Yanagisawa et al.

(10) Patent No.: US 9,789,693 B2
(45) Date of Patent: Oct. 17, 2017

(54) LIQUID EJECTING APPARATUS AND POSITION ADJUSTING METHOD

(71) Applicant: SEIKO EPSON CORPORATION, Tokyo (JP)

(72) Inventors: Hirofumi Yanagisawa, Shiojiri (JP); Kenichi Miyazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/970,229

(22) Filed: Dec. 15, 2015

(65) Prior Publication Data

US 2016/0200108 A1 Jul. 14, 2016

(30) Foreign Application Priority Data

Jan. 9, 2015 (JP) ..... 2015-003203

(51) Int. Cl.
*B41J 2/175* (2006.01)
*B41J 11/00* (2006.01)

(52) U.S. Cl.
CPC ..... *B41J 2/175* (2013.01); *B41J 2/1752* (2013.01); *B41J 11/001* (2013.01)

(58) Field of Classification Search
CPC .. B41J 2/17523; B41J 2/17553; B41J 2/1752; B41J 2/175; B41J 11/001
USPC ..... 347/84, 85, 86
See application file for complete search history.

(56) References Cited

U.S. PATENT DOCUMENTS 8,297,738 B1 * 10/2012 Kodama ..... B41J 2/1752 347/49
2005/0088493 A1 * 4/2005 Koga ..... H04N 1/00525 347/85
2014/0063142 A1 3/2014 Miyazaki et al.
2014/0063150 A1 3/2014 Miyazaki et al.

FOREIGN PATENT DOCUMENTS

| | | |
|---|---|---|
| JP | 2009-202347 | 9/2009 |
| JP | 2003-253866 | 9/2013 |
| JP | 2014-046567 | 3/2014 |
| JP | 2014-046568 | 3/2014 |
| JP | 2014-046588 | 3/2014 |
| JP | 2014-094536 | 5/2014 |
| JP | 2014-100267 | 6/2014 |

* cited by examiner

*Primary Examiner* — Jannelle M Lebron
(74) *Attorney, Agent, or Firm* — Workman Nydegger

(57) ABSTRACT

A liquid ejecting apparatus includes a liquid ejecting unit which can eject liquid; a connection unit to which a liquid container is connected along with a movement of the liquid container which can accommodate the liquid in a connecting direction; and a position adjusting unit which can change a position of the liquid container which is connected to the connection unit in a direction which intersects the connecting direction.

6 Claims, 6 Drawing Sheets

LIQUID EJECTING APPARATUS AND POSITION ADJUSTING METHOD

BACKGROUND

1. Technical Field

The present invention relates to a liquid ejecting apparatus which is connected to a liquid container, and a position adjusting method of a liquid container which is connected to the liquid ejecting apparatus.

2. Related Art

In the related art, there is an ink jet printer which performs printing by ejecting ink which is accommodated in an ink cartridge which is an example of a liquid container onto a medium such as a sheet, as a liquid ejecting apparatus which can eject ink. In such a printer, in general, supplying of ink is performed by exchanging an ink cartridge with a new ink cartridge by adopting a configuration in which the ink cartridge can be detachable in a housing thereof.

However, since the ink cartridge should be set to a size which can be accommodated in the housing, in a case in which it is difficult to make an apparatus large, printing of a large volume is performed, or the like, it is necessary to perform exchanging work by stopping printing every time ink in the ink cartridge is used up.

Therefore, there is a printer in which supplying of ink is performed by injecting ink into a carriage-type intermediate ink tank which is connected to a housing through an ink tube from an ink pack which is provided on the outside of the housing, in order to reduce such an exchanging work of an ink cartridge (for example, refer to JP-A-2009-202347).

Meanwhile, the above described intermediate ink tank is generally connected to a connection unit which is provided in a housing; however, when a size thereof is particularly large, a manufacturing error, or an attachment error of members becomes large, and accordingly, there is a concern that a position thereof may be deviated, and a connection failure may occur.

In addition, such a problem is not limited to a printer to which ink is supplied from an ink pack which is provided on the outside of the housing, and becomes approximately common to a liquid ejecting apparatus in which there is a risk of a position deviation of a liquid container to be connected along with a movement toward a connecting direction.

SUMMARY

An advantage of some aspects of the invention is to provide a liquid ejecting apparatus in which it is possible to adjust a position of a liquid container to be connected along with a movement toward a connecting direction in a direction which intersects the connecting direction.

Hereinafter, a unit for solving the above described problem, and operational effects thereof will be described.

According to an aspect of the invention, there is provided a liquid ejecting apparatus which includes a liquid ejecting unit which can eject liquid; a connection unit to which a liquid container is connected along with a movement of the liquid container which can accommodate the liquid in a connecting direction; and a position adjusting unit which can change a position of the liquid container which is connected to the connection unit in a direction which intersects the connecting direction.

According to the configuration, it is possible to adjust a position of the liquid container which is connected along with a movement in the connecting direction in the direction which intersects the connecting direction using the position adjusting unit.

In the liquid ejecting apparatus, the position adjusting unit may be arranged at a lower part in a vertical direction compared to the liquid container which is connected to the connection unit.

According to the configuration, since the position adjusting unit is arranged at the lower part in the vertical direction compared to the liquid container which is connected to the connection unit, it is possible to hold the liquid container at an appropriate position so that a connection thereof to the connection unit can be maintained, by supporting an own weight of the liquid container using the position adjusting unit.

In the liquid ejecting apparatus, the position adjusting unit may include a rotating member which configures a screw pair, and the liquid container may move in the direction which intersects the connecting direction along with rotating of the rotating member.

According to the configuration, it is possible to adjust a position of the liquid container in a stepless manner by moving the liquid container along with rotating of the rotating member which is included in the position adjusting unit.

In the liquid ejecting apparatus, the rotating member may include a shaft unit in which a male screw unit is formed at a peripheral face, the position adjusting unit includes an abutting unit with which a tip end of the shaft unit of the rotating member comes into contact rotatably, and a movable member in which a female screw unit which is screwed to the male screw unit is formed, and which supports the liquid container, in which a position of the liquid container is changed by causing the movable member to relatively move with respect to the abutting unit, by rotating the rotating member.

According to the configuration, when the rotating member rotates in a rotating direction in a state of being in contact with the abutting unit, the movable member which includes the female screw unit which is screwed to the male screw unit of the rotating member relatively moves in a shaft direction with respect to the abutting unit along with rotating of the rotating member. In this manner, it is possible to adjust a position of the liquid container, since the position of the liquid container which is supported by the movable member is moved along the shaft direction.

In the liquid ejecting apparatus, a tip end of the shaft unit in the rotating member may be a curved face.

According to the configuration, since the tip end of the shaft unit of the rotating member which comes into contact with the abutting unit is a curved face, it is possible to reduce a sliding resistance when rotating the rotating member.

According to another aspect of the invention, there is provided a position adjusting method which changes a position of a liquid container which is connected to a connection unit in a liquid ejecting apparatus which includes a liquid ejecting unit which can eject liquid; and the connection unit to which the liquid container which can accommodate the liquid is connected, the method including connecting the liquid container to the connection unit by moving the liquid container to a connecting direction in which the liquid container goes toward the connection unit; and changing a position of the liquid container along a direction which intersects the connecting direction.

According to the configuration, it is possible to adjust the position of the liquid container which is connected to the connection unit along with a movement toward the connecting direction in the direction which intersects the connecting direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the liquid ejecting apparatus will be described with reference to drawings.

Figure 1:
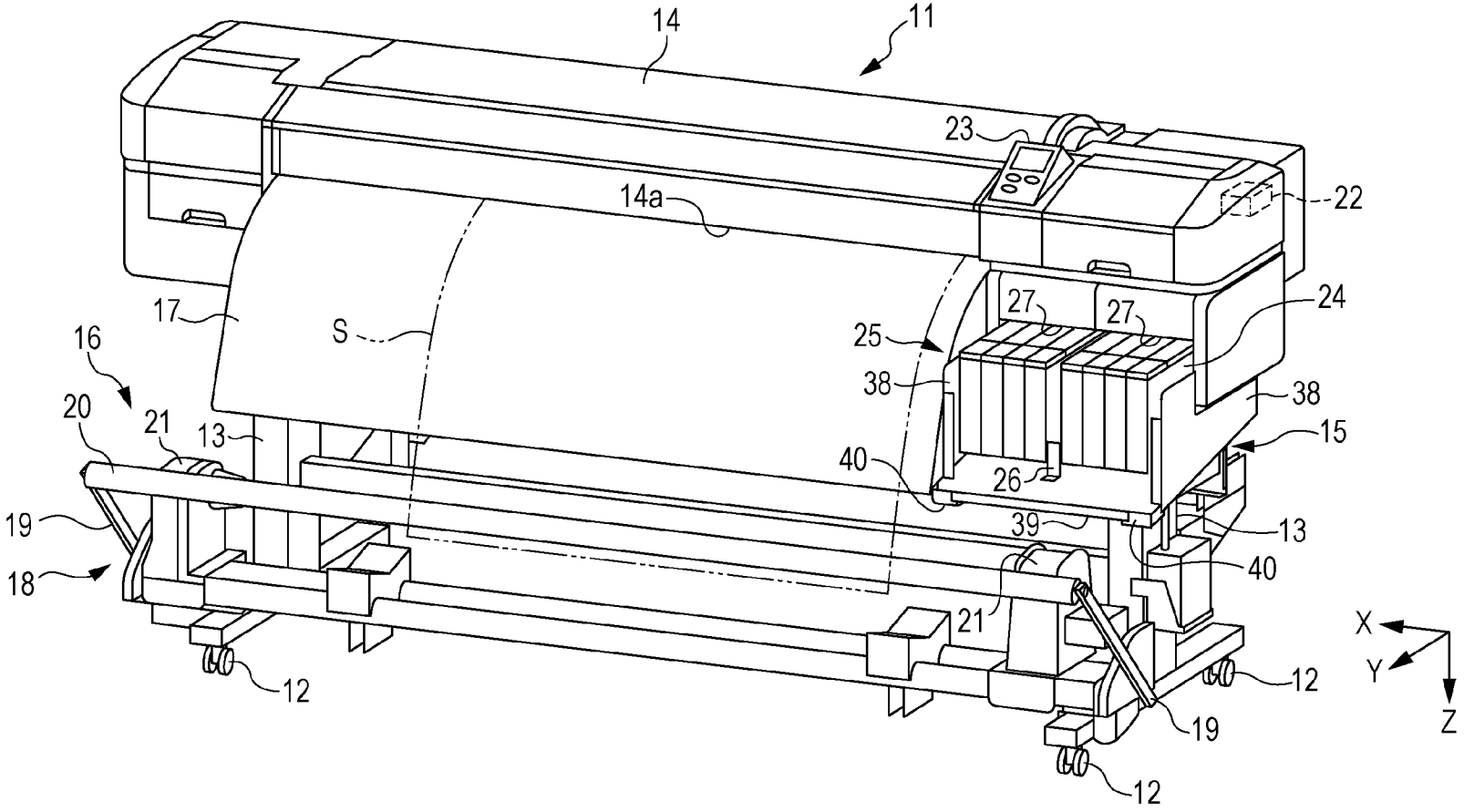
FIG. 1 is a perspective view which illustrates an embodiment of a liquid ejecting apparatus.

As illustrated in FIG. 1, a liquid ejecting apparatus 11 according to the embodiment is a large format printer (LFP) which treats a long medium S such as a roll sheet. In addition, the liquid ejecting apparatus 11 includes a housing support unit 13 to which a wheel 12 is attached at a lower end, and a housing 14 which is assembled on the housing support unit 13. According to the embodiment, the housing support unit 13 is a pair of leg portions which supports the housing 14; however, it is also possible to change the housing support unit to another shape such as leg portions of three or more with no wheel, a box-shaped base, or the like.

In the embodiment, a direction which intersects (orthogonal in the embodiment) a gravity direction Z (lower part in vertical direction), and goes toward the front face from the rear portion of the housing 14 is set to a front direction Y. In addition, a direction which intersects both the gravity direction and the front direction Y (orthogonal in the embodiment), and goes from one end side (right end side in FIG. 1) toward the other end side (left end side in FIG. 1) is set to a movement direction X.

A feeding unit 15 which feeds a medium S toward the housing 14 side is arranged at a lower part on the rear side of the housing 14. A winding unit 16 which is supported by the housing support unit 13 is arranged at a lower part on the front side of the housing 14. A medium supporting unit 17 is arranged between the feeding unit 15 and the winding unit 16 along a transport path of the medium S. A discharging port 14*a* for discharging the medium S from the housing 14 is formed at a position which is a higher side of the medium supporting unit 17 on the front face side of the housing 14.

A tension applying mechanism 18 which applies tension to the medium S which is located between the medium supporting unit 17 and the winding unit 16 is provided in the vicinity of the winding unit 16. The tension applying mechanism 18 is provided with a pair of arm members 19 which is rotatably supported at the lower part of the housing support unit 13, and a tension roller 20 which is rotatably supported at a tip end portion of the pair of arm members 19.

The winding unit 16 includes a pair of holders 21 which interposes a core member (not illustrated) (for example, paper tube) which winds up the medium S after being printed in a cylindrical shape. In addition, the medium S is wound around the core member which is mounted between the pair of holders 21 when one (right side in FIG. 1) of the holders 21 rotates. That is, the winding unit 16 configures a transport mechanism, and the holder 21 is located on the downstream side of the transport path of the medium S. In addition, the winding unit 16 according to the embodiment is a spindleless type in which a spindle is not used; however, it may be a type in which a spindle is used.

A control unit 22 which controls operations of the liquid ejecting apparatus 11 is provided in the housing 14. In addition, an operation panel 23 which performs a setting operation, or an input operation is provided on one end side (right end side in FIG. 1) which is the outer side on the transport path of the medium S in the movement direction X, at the higher part of the housing 14. In addition, the operation panel 23 is electrically connected to the control unit 22.

Two accommodating units 27 which are capable of accommodating a part of a liquid container 24 which can accommodate liquid such as ink, for example, are provided at one end side (right end side in FIG. 1) which is the outer side on the transport path of the medium S in the movement direction X, at the lower part of the housing 14.

A plurality of (five in the embodiment) the liquid containers 24 which are prepared according to types and colors of liquid can be inserted into one accommodating unit 27, and according to the embodiment, four liquid containers 24 are accommodated in two accommodating units 27. In addition, the plurality of liquid containers 24 which are accommodated in one accommodating unit 27 is referred to as one liquid accommodating unit 25. It is possible to arbitrarily change the number of liquid containers 24 which can be accommodated in one accommodating unit 27, the number of liquid containers 24 which configure the liquid accommodating unit 25, and the number of liquid accommodating units 25 (that is, the number of accommodating units 27).

A protecting plate 38 which protects the liquid container 24, a liquid receiving unit 39 which can receive liquid which is leaked from the liquid container 24, and a liquid storage member 40 which can store liquid which is received using the liquid receiving unit 39 are provided at the periphery of the liquid accommodating unit 25 of two sets.

Figure 2:
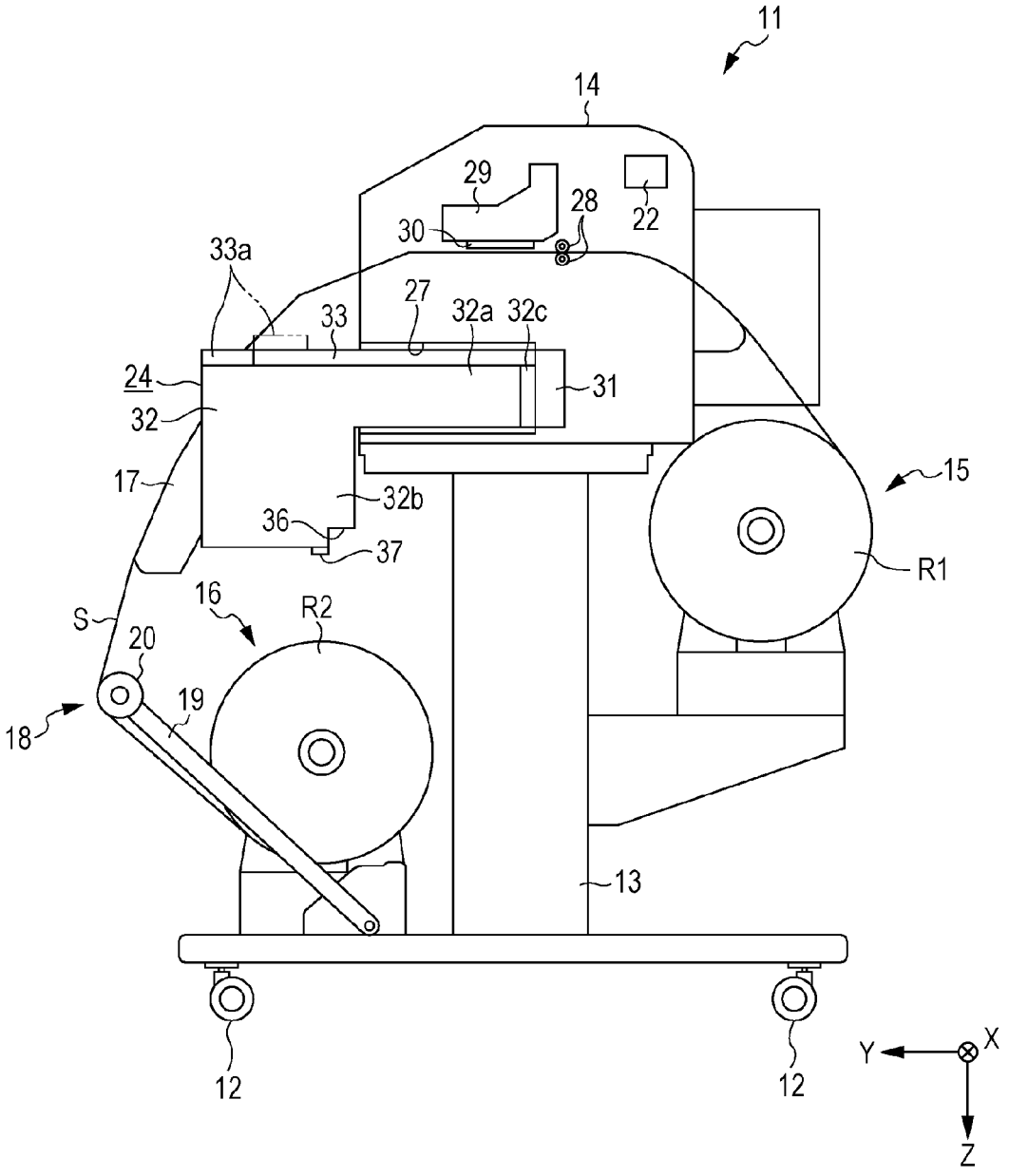
FIG. 2 is a schematic view which illustrates an internal configuration of the liquid ejecting apparatus in FIG. 1 when viewed from a side.

As illustrated in FIG. 2, a roll body R1 around which the medium S which is not used is wound in a cylindrical shape is held in the feeding unit 15. In addition, in the housing 14, a pair of transport rollers 28 which transports the medium S which is sent from the feeding unit 15, and a carriage 29 which performs a reciprocating movement in the movement direction X which is orthogonal to the transport direction of the medium S are accommodated. A liquid ejecting unit 30 which can eject liquid such as ink, for example, is held at the lower part of the carriage 29. In addition, recording (printing) is performed when the liquid ejecting unit 30 ejects ink which is supplied from the liquid container 24 onto the medium S which is transported along the transport path. In conclusion, the liquid ejecting apparatus 11 includes the liquid ejecting unit 30 which can eject liquid.

A heater (not illustrated) for drying liquid which is attached to the medium S is built in the medium supporting unit 17. In addition, the medium S after printing is guided obliquely downward along the medium supporting unit 17, is wound using the winding unit 16 thereafter, and forms a roll body R2.

In the housing 14, a plurality of connection units 31 for connecting the liquid container 24 are provided on the deep side of the accommodating unit 27. The liquid container 24 includes a liquid accommodating body 32 which can accommodate liquid in the inside, and a slider 33 which can move in a sliding manner in the front direction Y along a top face of the liquid accommodating body 32. A part on the front end side of the slider 33 becomes a rotatable lid unit 33*a*. The lid unit 33*a* of the slider 33 is arranged at an open position which is denoted by a two-dot chain line by being rotated upward from a closed position which is denoted by a solid line in FIG. 2.

The liquid accommodating body 32 includes a base end portion 32*a* which is accommodated in the accommodating unit 27, and a protruding portion 32*b* which protrudes from the housing 14 in a protruding direction (front direction Y in the embodiment) which intersects the gravity direction Z.

A liquid deriving unit 32*c* which is connected to the connection unit 31 in the housing 14 in a state of being capable of deriving liquid is provided in the base end portion 32*a*, in the liquid accommodating body 32.

In addition, in the liquid container 24, when the base end portion 32*a* is accommodated in the accommodating unit 27 along with a movement toward a connecting direction (according to the embodiment, rear side which is direction opposite to protruding direction), the liquid deriving unit 32*c* is connected to the connection unit 31. In other words, the connection unit 31 is a portion to which the liquid container 24 is connected along with a movement of the liquid container 24 which can accommodate liquid in the connecting direction. In the liquid container 24 which is connected to the connection unit 31, a base portion of the base end portion 32*a* is supported by an inner base portion of the accommodating unit 27.

In the state in which the liquid container 24 is accommodated in the connection unit 31, the protruding portion 32*b* of the liquid accommodating body 32 is extended downward compared to the base end portion 32*a* side. In addition, a base portion on the protruding portion 32*b* side in the liquid container 24 is arranged downward compared to the base portion of the housing 14.

In the liquid accommodating body 32, a base portion with step difference 36 is formed at the rear side lower portion of the protruding portion 32*b*. In addition, in the liquid accommodating body 32, a protruding portion for screwing 37 protrudes at a position which is the front side of the base portion with step difference 36 at the lower end portion of the protruding portion 32*b*. In the following descriptions, in the protruding portion 32*b* of the liquid accommodating body 32, an end portion on a side on which the base portion with step difference 36 is provided in the antero-posterior direction will be referred to as a rear end side, and an end portion on the front side which is a side opposite thereto will be referred to as a protruding end side.

Figure 3:
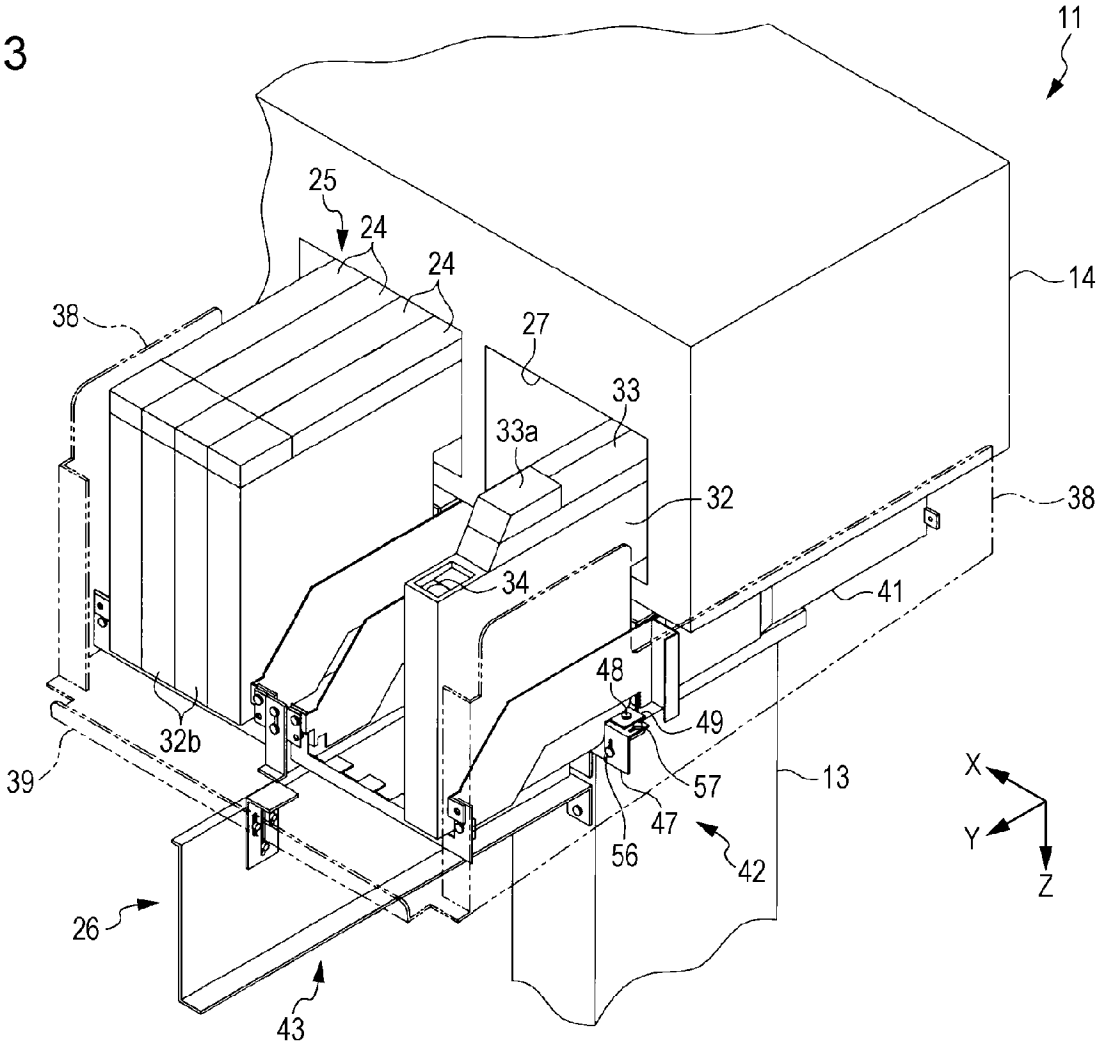
FIG. 3 is a perspective view of a liquid container and a support unit.

When the lid unit 33*a* of the slider 33 is arranged at the open position like the liquid container 24 which is located at the right end in FIG. 3, an inlet 34 of liquid which is formed on a top face side of the liquid accommodating body 32 is exposed. In addition, in the liquid container 24, when liquid is injected from the inlet 34, liquid is accommodated in the liquid accommodating body 32.

Here, in the liquid container 24, there is also a case in which an amount of liquid which is stored in the protruding portion 32*b* which protrudes from the housing 14 is larger than an amount of liquid which is stored on the base end portion 32*a* side, and when liquid is injected, a center of gravity moves forward. In addition, since the protruding portion 32*b* protrudes from the housing 14, there is a concern that an excessive load may be applied to the protruding portion 32*b*, when work of injecting liquid from the inlet 34 is performed, stuff is unintentionally placed on the protruding portion 32*b*, or the like, for example.

In such a case, there is a concern that a connection failure with respect to the connection unit 31 of the liquid deriving unit 32*c* may occur due to floating of the base end portion 32*a*, and as a result, liquid may be leaked, or air may be mixed, when a protruding end of the protruding portion 32*b* is lowered, and the liquid container 24 is tilted (rotated). In order to reduce such a risk, in the liquid ejecting apparatus 11 according to the embodiment, a support unit 26 which supports the protruding portion 32*b* of the liquid container 24 on the outside of the housing 14 is provided. It is preferable to arrange the support unit 26 at the lower part in the vertical direction compared to the liquid container 24 in order to efficiently support an own weight of the liquid container 24, and a load which is applied to the protruding portion 32*b*.

Subsequently, a configuration of the support unit 26 will be described in detail.

As illustrated in FIG. 3, the support unit 26 includes a support frame 41 which is provided in each of the liquid accommodating unit 25 in form of being connected to the housing 14, a rear end support unit 42 which can support the rear end side of the protruding portion 32*b* in the liquid accommodating body 32, and a protruding end support unit 43 which can support the protruding end side of the protruding portion 32*b*.

In addition, in FIG. 3, a liquid storage member 40 is not illustrated, and the protecting plate 38 and the liquid receiving unit 39 are denoted using a two-dotted chain line in order to clearly state configurations of the rear end support unit 42 and the protruding end support unit 43. The protecting plates 38 are supported by the housing 14 through the support frame 41 so as to interpose the liquid accommodating unit 25 of two sets therebetween. The liquid receiving unit 39 is connected to the lower end portion of the protecting plate 38 in a form of being arranged at the lower part of the protruding portion 32*b* in the vertical direction of the liquid accommodating unit 25 of two sets.

Subsequently, a configuration of the rear end support unit 42 will be described in detail.

Figure 4:
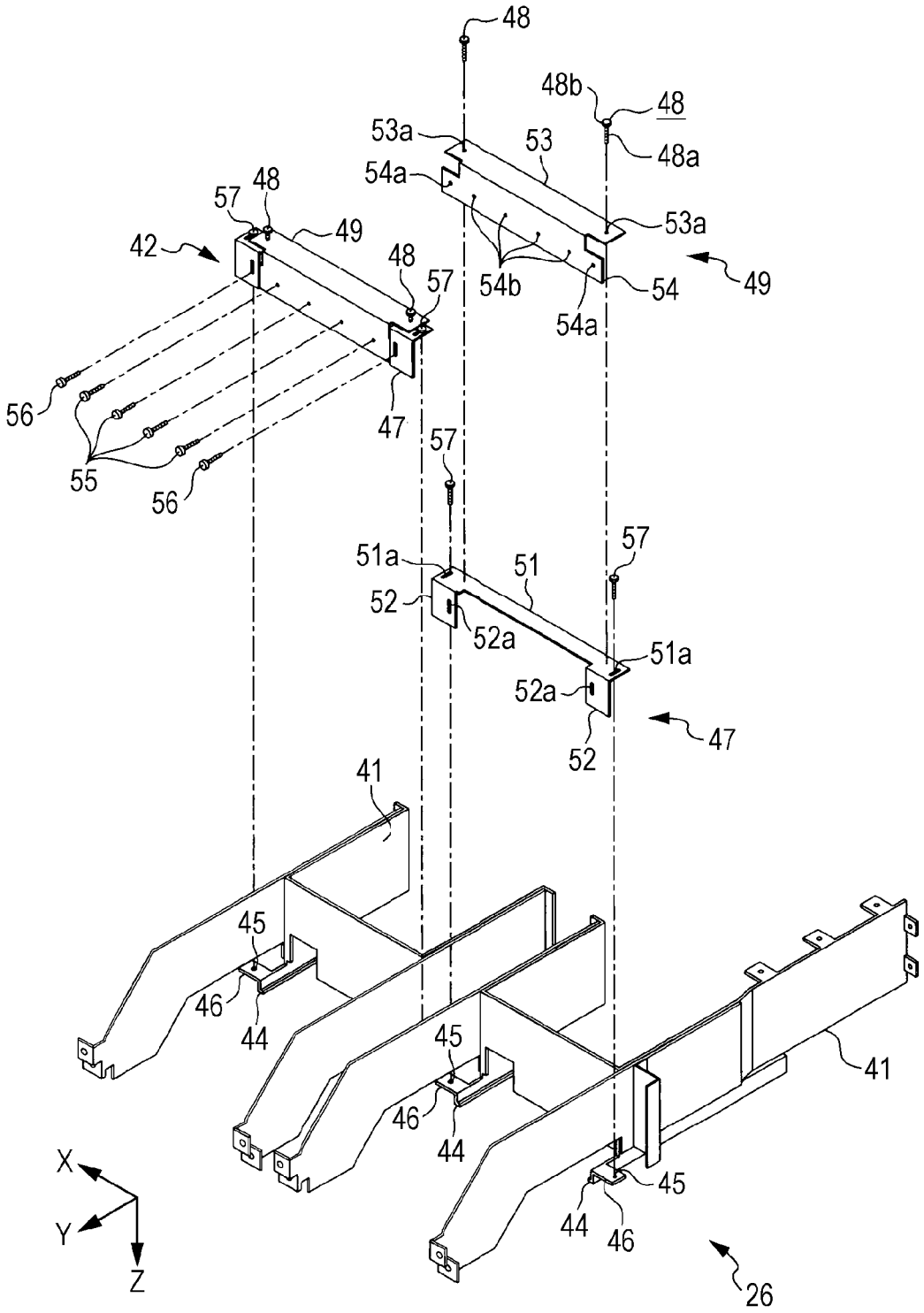
FIG. 4 is an exploded perspective view of a rear end support unit.

As illustrated in FIG. 4, the support frame 41 includes a pair of support arms 44 which extends in the protruding direction. A plate-shaped mounting unit 46 which includes a screwing hole 45, and extends in a direction intersecting the gravity direction Z is provided in a protruding manner at a protruding end of the support arm 44.

The rear end support unit 42 includes a support member 47 of which both ends in the longitudinal direction are supported by the pair of support arms 44, a rotating member 48, a movable member 49 which is supported by the support member 47 through the rotating member 48. The rotating member 48 and the movable member 49 configure a screw pair, and function as a position adjusting unit which can change a position of the liquid container 24 which is connected to the connection unit 31 (particularly, position at rear end portion of protruding portion 32*b*) in a direction which intersects the connecting direction. That is, the liquid ejecting apparatus 11 includes the position adjusting unit which can change a position of the liquid container 24 which is connected to the connection unit 31 in a direction which intersects the connecting direction. At this time, the position adjusting unit is arranged at the lower part in the vertical direction compared to the liquid container 24 which is connected to the connection unit 31. The rotating member 48 is a male screw (bolt) which includes a shaft unit 48*a* in which a male screw unit is formed at the outer peripheral face, and a head portion 48*b* which is provided at a based end portion of the shaft unit 48*a*, for example.

The support member 47 includes an abutting unit 51 which extends in the movement direction X which is the longitudinal direction, and the protruding direction, and a pair of locking plate units 52 which extends in the gravity direction Z from both end portions of the abutting unit 51 in the longitudinal direction. A long hole 51*a* which extends in the protruding direction is formed at both end portions of the abutting unit 51 in the longitudinal direction, and meanwhile, a long hole 52*a* which extends in the gravity direction Z is formed in the pair of locking plate units 52.

The movable member 49 includes a mounting plate unit 53 which extends in the movement direction X which is the longitudinal direction, and the protruding direction so as to overlap with the abutting unit 51 of the support member 47, and a fixing plate unit 54 which extends in the gravity direction Z from a tip end of the mounting plate unit 53 in the protruding direction.

The mounting plate unit 53 includes a screw hole 53*a* in which the female screw unit to which the male screw unit which is formed in the shaft unit 48*a* of the rotating member 48 is screwed at both end portions in the longitudinal direction. A screw hole 54*a* is formed at both end portions of the fixing plate unit 54 in the longitudinal direction. In addition, in the fixing plate unit 54, a plurality of (four in the embodiment) screwing holes 54*b* are formed at a position between the pair of screw holes 54*a*, and is a position which corresponds to the protruding portion for screwing 37 of the liquid accommodating body 32 in the longitudinal direction.

The mounting plate unit 53 of the movable member 49 is arranged at the higher part in the vertical direction compared to the abutting unit 51 of the support member 47, and meanwhile, the fixing plate unit 54 of the movable member 49 is arranged on the rear side compared to the locking plate unit 52 of the support member 47. In addition, the movable member 49 and the support member 47 are fixed using a first adjusting screw 56 which is inserted into the long hole 52*a* and the screw hole 54*a* from the front side. In addition, the support member 47 is fixed to the mounting unit 46 of the support arm 44 using a second adjusted screw 57 which is inserted into the long hole 51*a* and the screwing hole 45 from the higher part in the vertical direction. In this manner, loads of the movable member 49 and the support member 47 are supported by the housing 14 through the support arm 44 and the support frame 41.

In the vertical direction, a relative position of the movable member 49 with respect to the support member 47 can be adjusted by moving the support member 47 along the vertical direction in a state in which the first adjusting screw 56 which is inserted into the long hole 52*a* is loosened. That is, a movement of the movable member 49 in the vertical direction is allowed in a state in which the first adjusting screw 56 is loosened. In addition, positions of the movable member 49 and the support member 47 in the protruding direction can be adjusted by moving the support member 47 along the protruding direction in a state in which the second adjusted screw 57 which is inserted into the long hole 51*a* is loosened.

Figure 5:
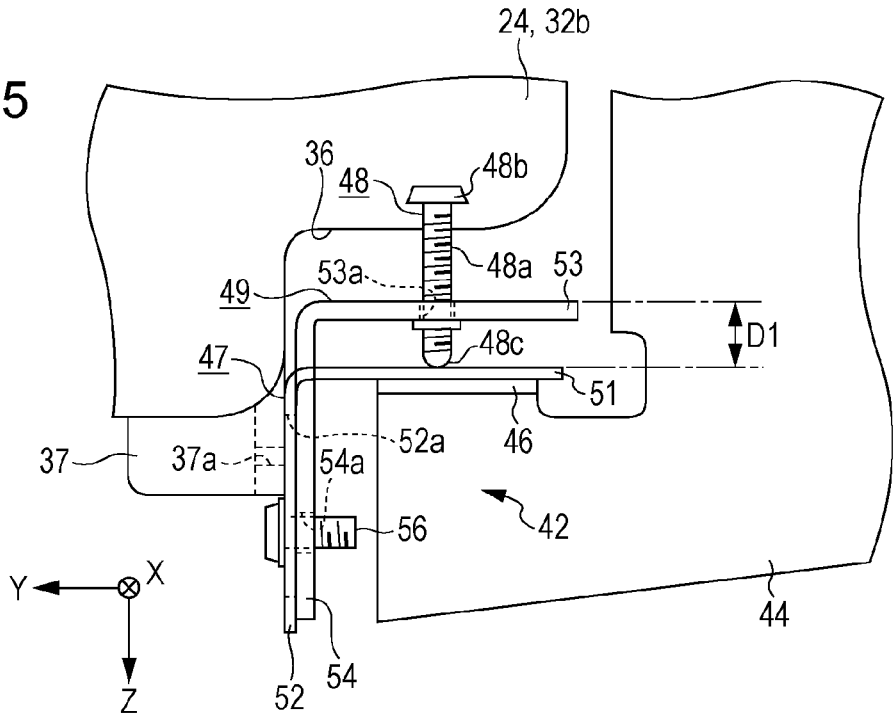
FIG. 5 is a side view which illustrates the rear end support unit before performing adjusting of a position.

It is preferable that a tip end of the shaft unit 48*a* of the rotating member 48 is set to a curved face 48*c*. As illustrated in FIG. 5, according to the embodiment, the tip end of the shaft unit 48*a* in the rotating member 48 is the curved face 48*c*. In this manner, it is possible to reduce a sliding resistance when rotating the rotating member 48.

In the rotating member 48, the male screw unit of the shaft unit 48*a* is screwed to the female screw unit which is formed in the mounting plate unit 53, in a state in which the curved face 48*c* (that is, tip end of shaft unit 48*a*) comes into contact with a top face of the abutting unit 51 of the support member 47, rotatably.

At this time, when the movable member 49 is engaged with the support member 47, rotating of the shaft unit 48*a* in the shaft direction is suppressed. For this reason, when the rotating member 48 rotates in a state in which the first adjusting screw 56 is loosened, the movable member 49 moves along the vertical direction. That is, the rotating member 48 and the movable member 49 which function as a position adjusting unit adjust a position of the liquid container 24 in the vertical direction which intersects the connecting direction when the movable member 49 relatively moves with respect to the abutting unit 51 along with rotating of the rotating member 48. In conclusion, the position adjusting unit includes the rotating member 48 which configures a screw pair, and the liquid container 24 moves in a direction which intersects the connecting direction along with rotating of the rotating member 48. In addition, at this time, the rotating member 48 includes the shaft unit 48*a* in which the male screw unit is formed at the peripheral face. In addition, the position adjusting unit includes the abutting unit 51 with which the tip end of the shaft unit 48*a* of the rotating member 48 comes into contact, rotatably, and the movable member 49 in which the female screw unit which is screwed to the male screw unit is formed, and which supports the liquid container 24. A position of the liquid container 24 is changed when the movable member 49 is relatively moved with respect to the abutting unit 51, by rotating the rotating member 48.

In this manner, the movable member 49 includes the female screw unit which is screwed to the male screw unit of the rotating member 48, and supports the liquid container 24 in a state in which rotating of the rotating member 48 in the rotating direction is suppressed. In addition, the movable member 49 is supported through the rotating member 48 which is in point contact with the support member 47; however, tilting of the movable member 49 is suppressed when the fixing plate unit 54 of the movable member 49 is locked to the locking plate unit 52 of the support member 47.

Subsequently, a position adjusting method for adjusting a position of the liquid container 24 using the rear end support unit 42 will be described.

First, each constituent member of the rear end support unit 42 is assembled as described above, and is set to a state of temporary stop in which the first adjusting screw 56 and the second adjusted screw 57 are loosened.

Subsequently, the liquid container 24 is connected to the connection unit 31 by being moved in the connecting direction in which the liquid container goes toward the connection unit 31 (connecting process).

Subsequently, a position of the liquid container 24 is adjusted along a direction which intersects the connecting direction by relatively moving the movable member 49 with respect to the support member 47 along the vertical direction, by rotating the rotating member (vertical position adjusting process).

For example, when a position of the mounting unit 46 is lower than a position which is regulated, and there is a gap between the base portion with step difference 36 of the liquid container 24 and the movable member 49, as illustrated in FIG. 5, the movable member 49 is moved to the higher part in the vertical direction by rotating the rotating member 48 in one direction from a state in which a distance between the mounting plate unit 53 and the abutting unit 51 is D1.

Figure 6:
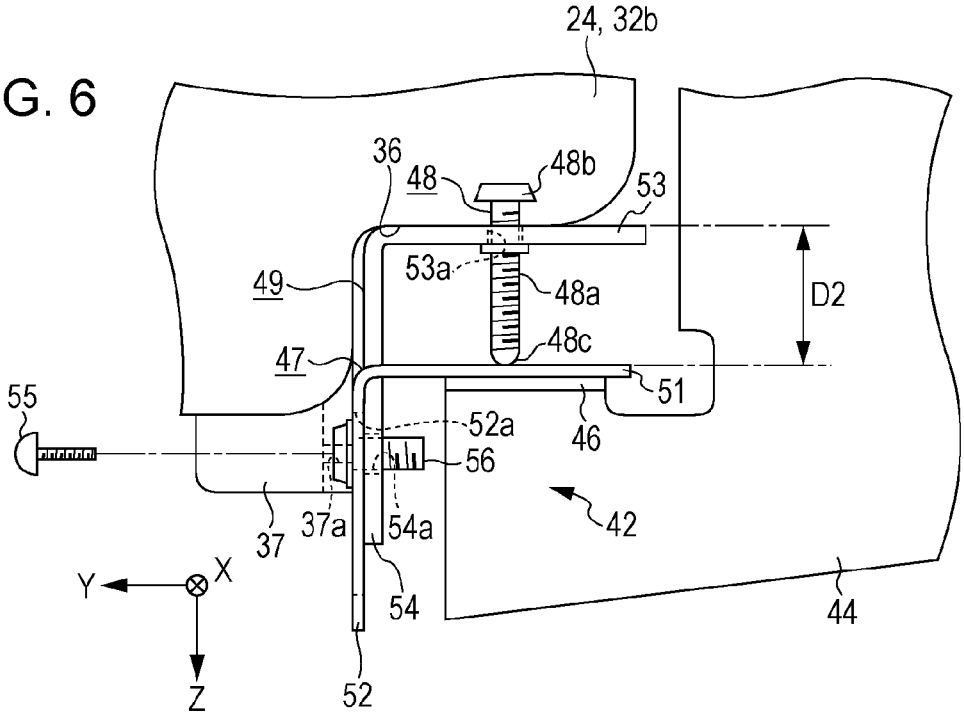
FIG. 6 is a side view which illustrates the rear end support unit after performing adjusting of a position.

As a result, as illustrated in FIG. 6, the distance between the mounting plate unit 53 and the abutting unit 51 is enlarged to D2 (D2>D1), and the mounting plate unit 53 of the movable member 49 comes into contact with the base portion with step difference 36 of the liquid container 24. In this manner, by moving the liquid container 24 along with the movable member 49, a load of the liquid container 24 can be reliably transmitted to the mounting unit 46 through the rear end support unit 42. In addition, it is possible to accurately adjust the position even when there is a manufacturing error, or the like, in the liquid container 24, by adjusting the position of the liquid container 24 which is connected to the connection unit 31 in the connecting process, in the vertical position adjusting process.

In addition, in the vertical position adjusting process, a gap between the plurality of liquid containers 24 and a top face of the accommodating unit 27 may be set to be constant by moving the liquid container 24 to a position at which a jig is interposed between the slider 33 and the top face of the accommodating unit 27, by inserting the block-shaped jig for position adjusting between the slider 33 of the liquid accommodating unit 24 and the top face of the accommodating unit 27.

The movable member 49 is fixed to the support member 47 by tightly fastening the first adjusting screw 56 after arranging the movable member 49 at an appropriate position in the vertical direction (movable member fixing process).

Subsequently, the rear end side of the protruding portion 32*b* is fixed to the movable member 49 by inserting a container fixing screw 55 into a screw hole 37*a* which is provided in the protruding portion for screwing 37 of the liquid container 24, and the screwing hole 54*b* (container fixing process).

Subsequently, a position of the liquid container 24 in the protruding direction is adjusted by lightly pushing the front face of the liquid container 24 toward the housing 14 side (protrusion portion adjusting process). Thereafter, a position of the support member 47 in the protruding direction is fixed by tightly fastening the second adjusted screw 57 (support member fixing process). In addition, even when there is a manufacturing error, or the like, in the liquid container 24, it is possible to accurately adjust a position in the protruding direction, by adjusting the position of the liquid container 24 which is fixed to the movable member 49 in the container fixing process, in the protrusion portion adjusting process.

When concluding the position adjusting method according to the embodiment, it is a position adjusting method in which a position of the liquid container 24 which is connected to the connection unit 31 is changed in the liquid ejecting apparatus 11 which includes the liquid ejecting unit 30 which can eject ink, and a connection unit 31 to which the liquid container 24 which can accommodate liquid is connected, in which the liquid container 24 is connected to the connection unit 31 by being moved in the connecting direction in which the liquid container goes toward the connection unit 31, and a position of the liquid container 24 is changed along a direction which intersects the connecting direction. In this manner, it is possible to adjust the position of the liquid container 24 which is connected along with a movement in the connecting direction, in a direction which intersects the connecting direction.

Incidentally, in FIG. 5, a gap between the base portion with step difference 36 of the liquid container 24 and the movable member 49 is illustrated by being highlighted, in order to clearly illustrate operations of the movable member 49; however, in practice, there is a case in which the gap is not present due to tilting downward of the liquid container 24 on the front side. Also in this case, it is possible to move the liquid container 24 in the direction which intersects the connecting direction by lifting the protruding portion 32*b* of the liquid container 24 which is connected to the connection unit 31, by moving the movable member 49 along with rotating of the rotating member 48.

Subsequently, operations of the liquid ejecting apparatus 11 which is configured as described above will be described.

When the liquid container 24 is connected to the connection unit 31, there is a concern that positions of the protruding portion 32*b* and the mounting unit 46 may be deviated due to a manufacturing error, an installation error, or the like, of the liquid container 24 or the support frame 41.

In that point, according to the embodiment, since it is possible to adjust a position of the movable member 49 in the vertical direction using rotating of the rotating member 48, it is possible to appropriately support the liquid container 24 through the support frame 41, even when the position of the mounting unit 46 is deviated.

In addition, since all of fixing operations of each of the constituent members of the rear end support unit 42 which performs those position adjustments are performed using a screw, when there is a general driver, it is possible to perform adjusting of position in a stepless manner along with a rotating operation thereof. In addition, it is possible to perform fixing of members using the same rotating operation of the driver. In addition, since it is possible to perform adjusting of position in a stepless manner in this manner, for example, even when positions of the pair of mounting units 46 are different on the right and left sides, it is possible to adjust the position of the liquid container 24 with high accuracy with respect to both of the mounting units 46. In addition, since adjusting of position is performed using a general driver, a special tool may not be used.

Figure 7:
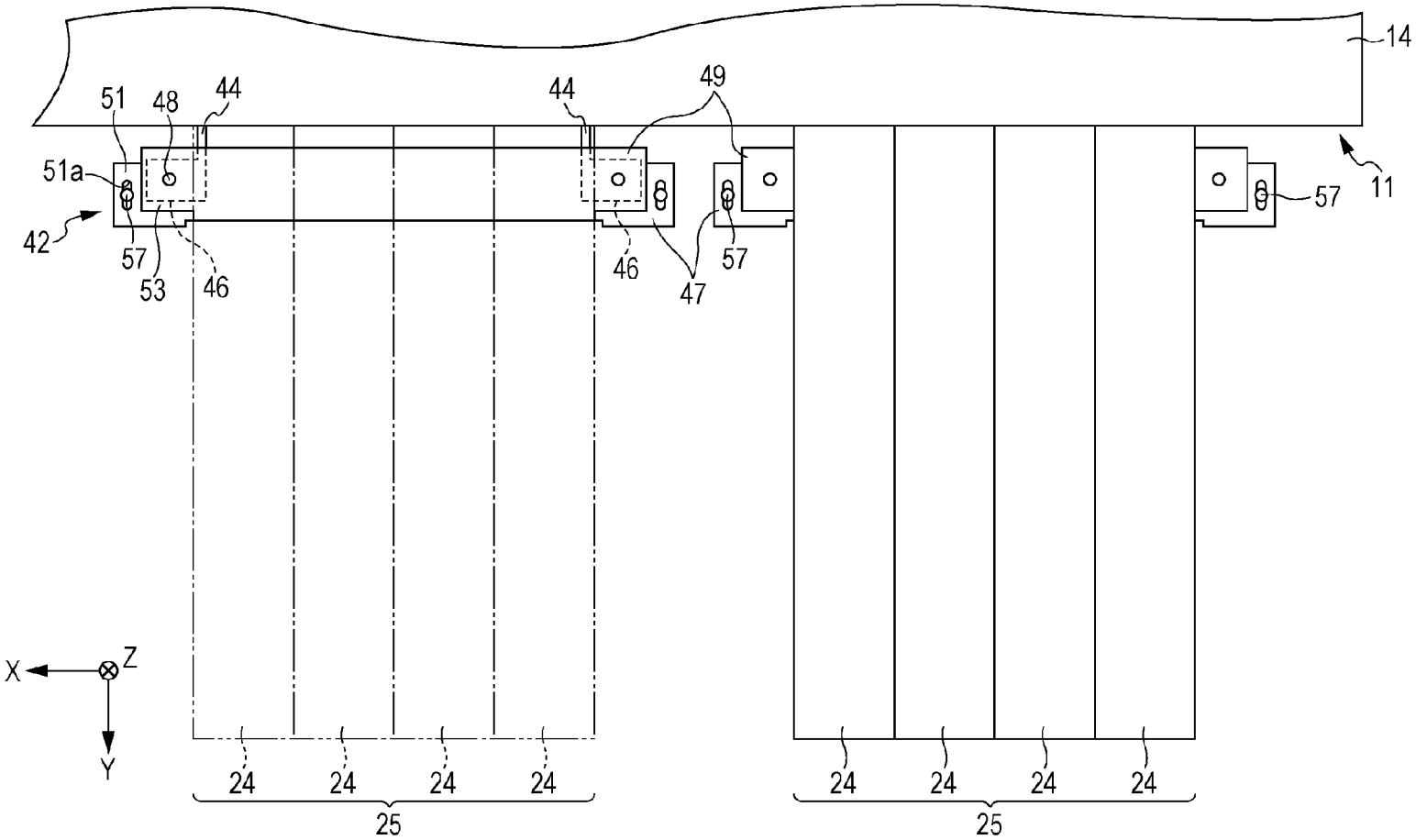
FIG. 7 is a top view of the liquid container and the rear end support unit.

For example, as illustrated in FIG. 7, the rotating members 48 for adjusting position of the movable member 49 are arranged at both ends on the right and left sides of the liquid accommodating unit 25, and it is possible to easily perform a rotating operation by inserting a driver from the higher side using a space on the higher part thereof.

According to the above described embodiment, it is possible to obtain the following effects.

(1) In the process of adjusting position, it is possible to adjust a position of the liquid container 24 which is connected along with a movement in the connecting direction in a direction which intersects the connecting direction using the movable member 49 and the rotating member 48 which function as the position adjusting unit.

(2) Since the movable member 49 and the rotating member 48 which function as the position adjusting unit are arranged at the lower part in the vertical direction compared to the liquid container 24 which is connected to the connection unit 31, it is possible to hold the liquid container 24 at an appropriate position so that a connection to the connection unit 31 unit can be maintained, by supporting an own weight of the liquid container 24 using the movable member 49.

(3) It is possible to adjust a position of the liquid container 24 in a stepless manner by moving the liquid container 24 along with rotating of the rotating member 48 which functions as the position adjusting unit. For this reason, it is possible to adjust the position with good accuracy compared to a case in which a spacer (plate, or the like) with a predetermined thickness is inserted one by one between the liquid container 24 and the support member 47, for example.

(4) When the rotating member 48 rotates in the rotating direction in a state of being in contact with the abutting unit 51, since rotating of the movable member 49 which has the female screw unit which is screwed to the male screw unit of the rotating member 48 in the rotating direction is suppressed; however, on the other hand, a movement along the vertical direction (shaft direction) is allowed, the movable member relatively moves with respect to the abutting unit 51 in the shaft direction along with rotating of the rotating member 48, and accordingly, it is possible to adjust a position of the liquid container 24, since the position of the liquid container 24 which is supported by the movable member 49 is moved along the shaft direction.

(5) Since the tip end of the shaft unit 48*a* of the rotating member 48 which comes into contact with the abutting unit 51 is formed of the curved face 48*c*, it is possible to reduce a sliding resistance when rotating the rotating member 48.

In addition, the above described embodiment can be changed as follows.

It may be a configuration in which a force which is necessary for uplifting the movable member 49 which is associated with rotating of the rotating member 48 is reduced by arranging an urging member such as a compression spring between the abutting unit 51 of the support member 47 and the mounting plate unit 53 of the movable member 49. In addition, it is possible to easily perform a work of arranging the liquid storage member 40 at an appropriate position by setting an elastic amount of the compression spring according to a distance to a position at which the liquid storage member 40 is to be arranged.

The tip end of the shaft unit 48*a* of the rotating member 48 is not limited to the curved face 48*c*, and may be a flat surface, or a conical shape.

The liquid ejecting apparatus 11 may not include any one, or all of the protruding end support unit 43, the protecting plate 38, the liquid receiving unit 39, and the liquid storage member 40.

In the rear end support unit 42, the position adjusting unit which performs adjusting of position of the liquid storage member 40 is not limited to a rotating member which configures a screw pair, and can also be configured of, for example, a cam member which configures a turning pair, a slider which configures a sliding pair, a piston which performs an elastic movement using an oil pressure, a jack, or the like. In addition, in this manner, by including the position adjusting unit which can perform adjusting of position in a stepless manner, it is possible to perform adjusting of position of the liquid storage member 40 with good accuracy.

It may be a configuration in which the liquid container 24 does not include the inlet 34.

The number of liquid containers 24 can be arbitrarily changed. Alternatively, it may be a configuration in which the liquid accommodating unit 25 is formed of a liquid container 24 in which the inlet 34 is provided, and a liquid container 24 in which the inlet 34 is not provided. For example, in a case in which monochrome printing is performed, or the like, when the inlet 34 is provided in a liquid container 24 which corresponds to black ink, it is possible to continuously perform monochrome printing of a large volume. In addition, in this case, a configuration in which a liquid container 24 which corresponds to color ink does not include the protruding portion 32*b* and the inlet 34, and all of the liquid containers 24 are accommodated in the housing 14 may be adopted.

The liquid container 24 may not necessarily be a container which accommodates liquid which is ejected from the liquid ejecting unit 30. For example, the liquid container 24 may be a container which accommodates cleaning liquid for performing cleaning of the liquid ejecting unit 30, moisturizing liquid for suppressing drying of the liquid ejecting unit 30, liquid which is discharged from the liquid ejecting unit 30 as waste liquid for maintenance, or the like.

The liquid container 24 may be connected to the connection unit 31 in a state of accommodating liquid, or may be injected with liquid through the inlet 34 after being connected to the connection unit 31 in an empty state in which liquid is not accommodated.

It may be a configuration in which it is possible to perform injecting of ink, and printing at the same time, by connecting a downstream end of an ink tube which is connected to an ink tank, or the like, of which an upstream end is arranged on the outside of the housing 14 to the inlet 34 of the liquid container 24.

The liquid ejecting apparatus 11 may be changed to a so-called line head liquid ejecting apparatus which does not include the carriage 29, includes a long and fixed liquid ejecting unit 30, and corresponds to the entire width of the medium S, for example. The liquid ejecting unit 30 in this case may be set to a unit in which a recording range extends over the entire width of the medium S, by arranging a plurality of unit head portions in which nozzles which eject liquid as ink droplets are formed in line, or may be set to a unit in which the recording range extends over the entire width of the medium S, by arranging a plurality of nozzles in a single long head so as to extend over the entire width of the medium S.

Liquid which is ejected or discharged from the liquid ejecting unit 30 is not limited to ink, and may be a liquid body, or the like, in which particles of a functional material are dispersed or mixed in liquid, for example. For example, it may be a configuration in which recording is performed by ejecting a liquid body including a material such as an electrode material which is used when manufacturing a liquid crystal display, an electroluminescence (EL) display, a surface light emitting display, and the like, or a coloring material (pixel material) in a form of dispersion or melting.

The entire disclosure of Japanese Patent Application No. 2015-003203, filed Jan. 9, 2015 is expressly incorporated reference herein.

What is claimed is:

1. A liquid ejecting apparatus comprising:

a liquid ejecting unit which can eject liquid;

a connection unit to which a liquid container that can accommodate the liquid is connected in a connecting direction along with a movement of the liquid container; and a position adjusting unit which can change a position of the liquid container which is connected to the connection unit in a direction which intersects the connecting direction with respect to the connecting unit while keeping an orientation of a top and bottom surface of the liquid container with respect to the connecting direction.

2. The liquid ejecting apparatus according to claim 1, wherein the position adjusting unit is arranged at a lower part in a vertical direction compared to the liquid container which is connected to the connection unit.

3. The liquid ejecting apparatus according to claim 1, wherein the position adjusting unit includes a rotating member which configures a screw pair, and wherein the liquid container moves in the direction which intersects the connecting direction along with rotating of the rotating member.

4. The liquid ejecting apparatus according to claim 3, wherein the rotating member includes a shaft unit in which a male screw unit is formed at a peripheral face, wherein the position adjusting unit includes an abutting unit with which a tip end of the shaft unit of the rotating member comes into contact rotatably, and a movable member in which a female screw unit which is screwed to the male screw unit is formed, and which supports the liquid container, and wherein a position of the liquid container is changed by causing the movable member to relatively move with respect to the abutting unit, by rotating the rotating member.

5. The liquid ejecting apparatus according to claim 4, wherein a tip end of the shaft unit in the rotating member is a curved face.

6. A position adjusting method which changes a position of a liquid container which can accommodate the liquid in a liquid ejecting apparatus which includes a liquid ejecting unit which can eject liquid, and the connection unit to which the liquid container is connected, the method comprising:

connecting the liquid container to the connection unit by moving the liquid container in a connecting direction in which the liquid container goes toward the connection unit; and changing a position of the liquid container along a direction which intersects the connecting direction with respect to the connecting unit while keeping an orientation of a top and bottom surface of the liquid container with respect to the connecting direction.

* * * * *